United States Patent [19]

Gibson et al.

[11] 3,998,346

[45] Dec. 21, 1976

[54] MATERIAL HANDLING APPARATUS

[75] Inventors: Christian D. Gibson; Ralph E. Allen; Donald G. Peters, all of Greene, N.Y.

[73] Assignee: The Raymond Corporation, Greene, N.Y.

[22] Filed: Feb. 3, 1975

[21] Appl. No.: 546,730

[52] U.S. Cl. ..... 214/730; 214/750

[51] Int. Cl.[2] ..... B66G 47/00

[58] Field of Search ..... 214/730–731, 214/16.4 A, 750

[56] References Cited

UNITED STATES PATENTS

| | | | |
|---|---|---|---|
| 2,799,418 | 7/1957 | Haldimann | 214/730 |
| 3,096,896 | 7/1963 | Norton et al. | 214/730 |
| 3,241,697 | 3/1966 | Rogant | 214/730 |
| 3,447,697 | 6/1969 | Morey et al. | 214/730 X |
| 3,572,530 | 3/1971 | Ohntoup | 214/730 |
| 3,868,034 | 2/1975 | Goodacre et al. | 214/730 |

FOREIGN PATENTS OR APPLICATIONS

| | | | |
|---|---|---|---|
| 750,793 | 6/1956 | United Kingdom | 214/730 |

*Primary Examiner*—Frank E. Werner
*Assistant Examiner*—R. B. Johnson
*Attorney, Agent, or Firm*—Richard G. Stephens

[57] ABSTRACT

The fork carriage of a side-loader truck is journalled for rotation about a vertical axis between two arms, one above and one below the carriage, which transmit lateral load moments to a narrow vertical member. A vertically-extending torque shaft journalled on the vertical member carries gears on its opposite ends. The gears engage laterally-extending racks spaced widely vertically apart on a rearward carriage, so that lateral load moments apply minimum forces to the racks, and rotation of the torque shaft also serves to laterally position the vertical member and the fork carriage. The rearward carriage may comprise an elevatable, mast-guided laterally-fixed carriage, or an intermediate carriage may be interposed between the vertical member and the laterally-fixed carriage to provide greater lateral load extension. An intermediate carriage having a roller arrangement insuring adequate support at any lateral load position is shown. By mounting the truck load wheels on the ends of an axle member, a given truck design can be readily adapted for use in aisles by numerous different widths without changes in a heavy welded base frame of the truck.

5 Claims, 19 Drawing Figures

MATERIAL HANDLING APPARATUS

This invention relates to material-handling apparatus, and more particularly, to an improved narrow-aisle lift truck.

The high cost of warehouse space makes it economically desirable that aisles between adjacent storage racks be made as narrow as possible, to increase the number of rows of racks which may be used in a given warehouse. Minimum aisle width is ordinarily determined by the aisle space required to operate a material-handling vehicle, such as a fork lift truck. For many years many warehouses have used lift-trucks having a pair of forwardly-extending load-supporting forks carried on a load carriage which is suspended on and roller-guided for vertical movement by a mast assembly. The mast assembly typically comprises a fixed upright section having a pair of vertically-extending laterally spaced apart structural members, and may include one or more telescopic mast sections. The forks (or other load manipulating device) support the load in cantilever fashion, so that the load tends to urge the fork tips downwardly, with the load carriage in turn tending to bend the mast assembly top forwardly, or longitudinally. Since the load center of gravity and the load carriage are laterally centered between the pair of members of each mast section, only very modest lateral bending moments are applied to the mast assembly through the load carriage by a load. Such trucks may enter the end of a long narrow aisle and proceed to a rack location at which a load is to be stored or picked up, but then they must turn 90 degrees to face a rack in order to pick up or deposit a load, so that the aisle width used with such trucks was often limited by the minimum turning radius of the trucks. Various trucks having an extremely short turning radius have been devised, so that turning radius frequently is no longer the main limitation affecting aisle width, but even if a truck yaving forwardly-extending forks is provided with a zero turning radius, aisle width must at least slightly exceed both the length and the width of the truck, and in fact exceed the largest diagonal dimension of the truck, to allow the truck to turn 90° in the aisle. Considerably narrower aisles resulting in great savings in warehouse space may be used with a class of "side-loading" trucks which need not turn in an aisle to deposit or pick up a load. Such trucks travel longitudinally along an aisle and are provided with a load-shifting mechanism which allows a load to be extended laterally beyond one (or both) sides of the truck and be lowered onto or be picked up from a shelf of a rack. Such trucks commonly employ a laterally-shiftable traverse carriage having a pair of load forks mounted thereon for 180° pivotal adjustment about a vertical axis, so the forks may be swung to laterally extend either downwardly or rightwardly. The extension of the center of gravity of a load laterally beyond a side of the truck poses several problems in side-loading trucks, including a potential imposition of large lateral bending moments on the mast assembly itself by the load, acting through the load carriage, and the imposition of large bending moments on the load carriage itself, tending to require the use of much heavier members both in the mast assembly and in the load carriage. These problems may be overcome in part by use of a novel crossed-chain carriage suspension technique described in U.S. Pat. No. 3,830,342. However, while use of the system of that patent can markedly reduce the lateral bending moments applied to the mast assembly, large lateral bending forces still may be imposed on members of the carriage and its side-shifting mechanism. One object of the present invention is to provide an improved carriage assembly and side-shifting structure which may be fabricated using lighter structural members, or put another way, to provide an assembly having a greater load capacity for a given amount of lateral load extension using a given weight of structural members. In an arrangement wherein the laterally-shiftable load-carrying mechanism or load handler must support the load from one lateral side or the other, the width of the aisle must exceed, with at least some small clearance, the sum of the dimension of the load in the aisle-width direction, plus the dimension of the load handler in that direction. Thus for a given aisle width, the narrower the load handler mechanism, the longer (in the aisle width direction) the load which can be stored and retrieved in the aisle, and conversely, for loads of a given size which must be stored and retrieved, the narrower the load handler mechanism, the narrower the aisle need be. Hence it becomes extremely desirable in the interests of conserving warehouse space, or in allowing larger loads to be stored, that the load handler mechanism used with such an arrangement adequately support a load and allow it to be moved laterally into or out of a rack shelf space, but consume minimum space measured in the aisle width direction. Thus a primary object of the invention is to provide improved apparatus for laterally positioning a pivotable fork carriage, or like load-manipulating device, which apparatus consumes a minimum amount of space in the aisle width direction.

In accordance with one feature of the present invention, a fork carriage is pivotally mounted vertically in between two arms which extend forwardly from a narrow vertically-extending structural member, with the lower of the arms pivotally engaging the bottom of the fork carriage. The wide vertical separation of the two arms greatly reduces the resultant forces which a given lateral load moment applies to the arms and to the fork carriage, so that the arms and fork carriage may be formed of lighter members, and the arms may have a modest width, aiding in the provision of a load-handling apparatus which consumes a minimum amount of space in the aisle width direction. Thus another object of the present invention is to provide improved material-handling apparatus having a fork carriage which is pivotable about a vertical axis and wherein arms having modest widths pivotally engage the fork carriage at its upper and lower extremities to transmit forces caused by lateral load moments rearwardly to a narrow vertically-extending structural member. The manner in which prior fork carriages pivotable about a vertical axis throughout 180 degrees have been mounted also has undesirably required that such carriages be formed of heavy members. A further object of the invention is to provide an improved arrangement for mounting such a carriage which greatly reduces the bending movements applied to the carriage, so that the carriage itself, as well as the mounting members, may be formed of lighter members for a given load capacity.

In accordance with a further feature of the invention, the force couple applied to the narrow vertically-extending structural member is transmitted further rearwardly by further means which consume minimum space in the lateral or aisle width direction, the further means comprising a vertically-extending tube or shaft means journalled on the vertical structural member, with gears on the upper and lower ends of the tube or shaft means engaging gear racks which extend laterally across the upper and lower edges of a rearward carriage. Such an arrangement causes the force couple resulting from a lateral load moment to apply purely horizontal forces to the gear racks on the rearward carriage, and with the length of the shaft means and the vertical separation of the gear racks made as great as possible, a given lateral load moment causes minimum forces at the gear racks. A separate single roller journalled on the narrow structural member engages a surface extending across the rearward carriage to transmit purely vertical force from the narrow structural member to the rearward carriage. As well as transmitting lateral load moments to the rearward carriage, the vertical shaft or tube is connected via a sprocket to be rotated by a motor carried on the narrow vertical member, so that operation of the motor moves the narrow vertical member and the fork carriage laterally relative to the rearward carriage. Thus another object of the invention is to provide an improved traverse carriage mechanism wherein gears spaced apart from each other along a vertically-extending shaft engage a pair of laterally-extending gear racks on a rearward carriage to transmit lateral load moments to the latter, and a further related object is to provide such a mechanism wherein the vertically-extending shaft also is motor-rotated to laterally translate a load-engaging device relative to laterally-fixed rearward structure. As will be seen below, the vertical shaft-gear rack arrangement may be used to transmit forces to a rearward carriage which is laterally fixed relative to a truck mast, or alternatively, the vertical shaft-gear rack arrangement may transmit forces to an intermediate laterally-shiftable carriage.

If a side-loader truck need not turn to pick up or deposit a load, the aisle width need barely exceed the truck width, and an automatic steering system which feels the racks on opposite sides of the aisle can be used. Side-loader trucks of this type have used a laterally-fixed elevatable carriage which in turn supports a laterally-movable fork carriage. The fixed carriage cannot, of course, be any wider than the aisle, and must be less to afford an adequate clearance. This consideration has limited lateral shifting of the traverse carriage, limiting the distance the forks can be extended into a rack to deposit or pick up a load. The width of prior traverse carriages has also undesirably limited how far they could be laterally shifted, since they must, of course, remain supported by their associated fixed carriage. This has required operation with an undesirably small clearance between a load in a rack and the traverse carriage load handler mechanism. In the case of some storage applications with some prior trucks, the limited allowable shifting of the traverse carriage required that a pallet being stored or picked up be handled with a multi-step procedure. A pallet being stored had to be extended as far into the rack as the limited traverse carriage motion would allow, then set down on the rack, the traverse carriage then partially retracted to partially retract the forks under the pallet, the fixed carriage again slightly raised to push up the load again, and the traverse carriage again extended with the pallet supported only by front portions of the forks, and the fixed carriage then lowered again to set the pallet in its final stored position. Such a multi-step arrangement may considerably slow down material-handling operations. Also, the operator could sometimes spill goods from a pallet if he retracted the forks too much during such a procedure. In accordance with a further feature of the invention, the need for such multi-step operations, and the need for operation with undesirably small clearances between a load handler and a load in a rack, are obviated by use of an intermediate carriage member between the laterally-fixed elevatable carriage and the traverse carriage. The traverse carriage may be driven to one end of the intermediate carriage member, and then the intermediate carriage itself may be driven some lateral distance in the same direction, thereby extending the forks and load further into the rack. Thus the distance which a load may be laterally shifted is the sum of the distance which the intermediate carriage member is shifted and the distance which the traverse carriage is shifted. The control system may be arranged so that lateral motions of the traverse carriage and the intermediate carriage are controlled independently of each other by the operator, or instead arranged so that lateral load of the intermediate carriage is automatically initiated when the traverse carriage reaches a limit position at one side (end of the intermediate carriage. The use of the intermediate carriage also allows the truck to operate efficiently in a greater variety of aisle widths. The use of two superimposed shifting mechanisms is not per se new, one such arrangement being shown in U.S. Pat. No. 3,390,789, for example, but prior art arrangements using laterally-shiftable intermediate mechanisms had various disadvantages, including difficulty in adequately supporting a laterally-extended load. An important feature of the intermediate carriage of the present invention is a roller arrangement which insures that the intermediate carriage is always properly supported on the side toward which the load has been extended.

To provide maximum truck lateral stability, it is desirable that the load-supporting wheels be laterally spaced as far apart as possible, very near the racks on opposite sides of an aisle. With automatically-steered trucks, it is also necessary that guide rollers on opposite sides of the truck be spaced to engage guide rail portions of the racks. Because a variety of different aisle widths are used in different warehouses, trucks of the prior art have been required to incorporate welded base frames having a variety of different widths, which has been expensive, and has limited the use of a given truck to aisles of a given width. In accordance with a further feature of the present invention, the heavy welded base frame of a truck is not tailored to a given aisle width; instead, the load wheels of the truck are mounted on the ends of an axle member which is bolted to the forward side of the base frame. Thus the same base frame may be used for trucks designed for a variety of different aisle widths, and different length axle members need merely be supplied for different width aisles. Similarly, longitudinally-extending members carrying guide rollers may be simply bolted to the axle and to the base frame to provide the guide roller spacing desired for a given installation.

Other objects of the invention will in part be obvious and will, in part appear hereinafter.

The invention accordingly comprises the features of construction, combination of elements, and arrangement of parts, which will be exemplified in the construction hereinafter set forth, and the scope of the invention will be indicated in the claims.

For a fuller understanding of the nature and objects of the invention reference should be had to the following detailed description taken in connection with the accompanying drawings, in which:

FIGS. 1*a*, 1*b*, 1*c* and 1*d* are geometric diagrams of portions of lift trucks useful in understanding several problems of lift truck construction which have been solved by the present invention.

FIGS. 2*a*, 2*b* and 2*c* are front elevational, end elevational, and plan views, respectively, of the elevatable and lowerable laterally-fixed carriage portion of a preferred embodiment of the invention.

FIGS. 3*a*, 3*b* and 3*c* are front elevation, end elevational, and rear elevational views, respectively of the intermediate carriage portion of the preferred embodiment of the invention.

FIGS. 4*a* and 4*b* are side elevational and rear elevational views, respectively of the traverse carriage or load handler portion of the preferred embodiment of the invention.

Figure 7A:
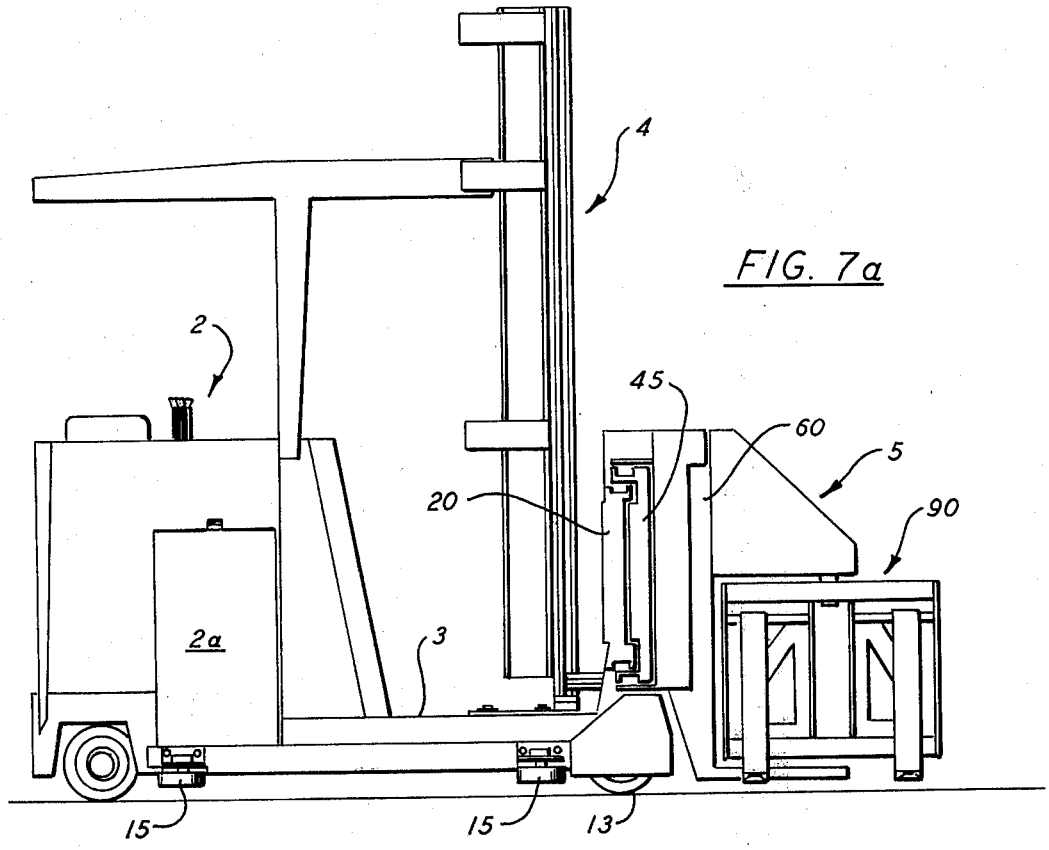

FIG. 7*a* is a side view of one form of truck constructed in accordance with the present invention.

Figure 7B:
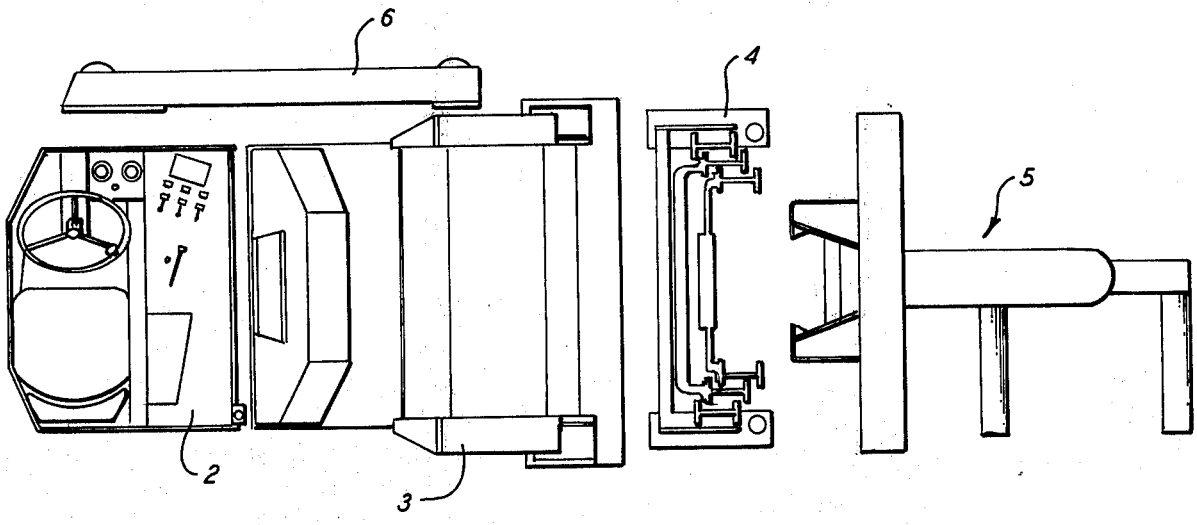

FIG. 7*b* is an exploded plan view illustrating separate portions of the truck of FIG. 7*a*.

Figure 7E:
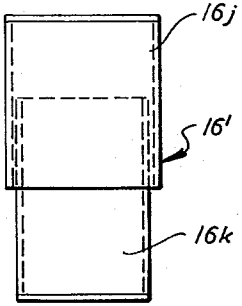
Figure 7C:
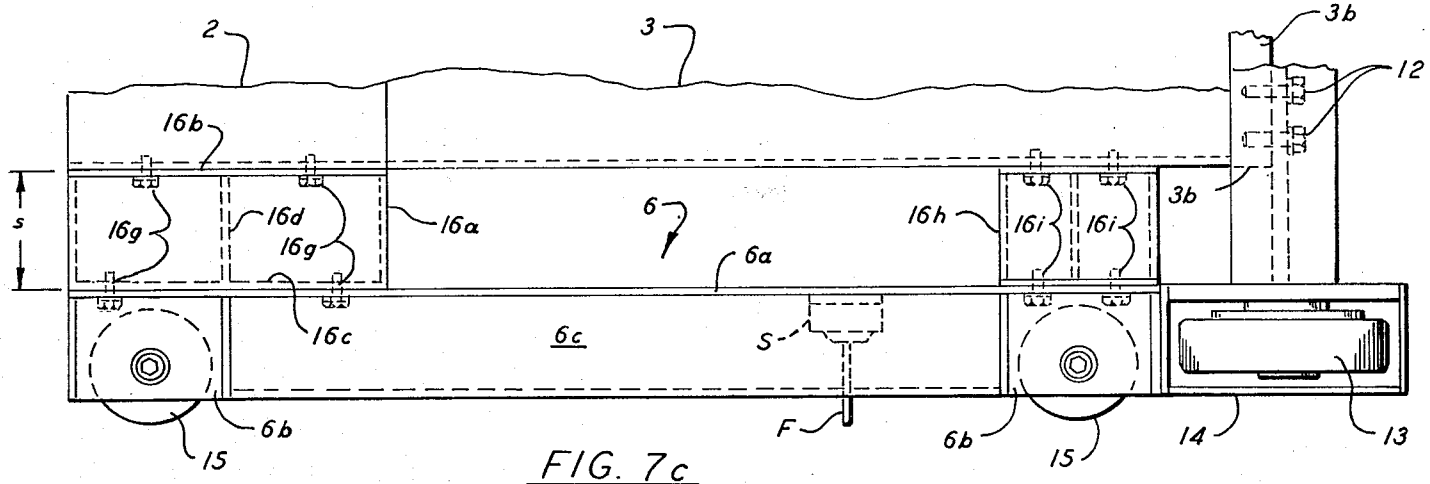
Figure 7D:
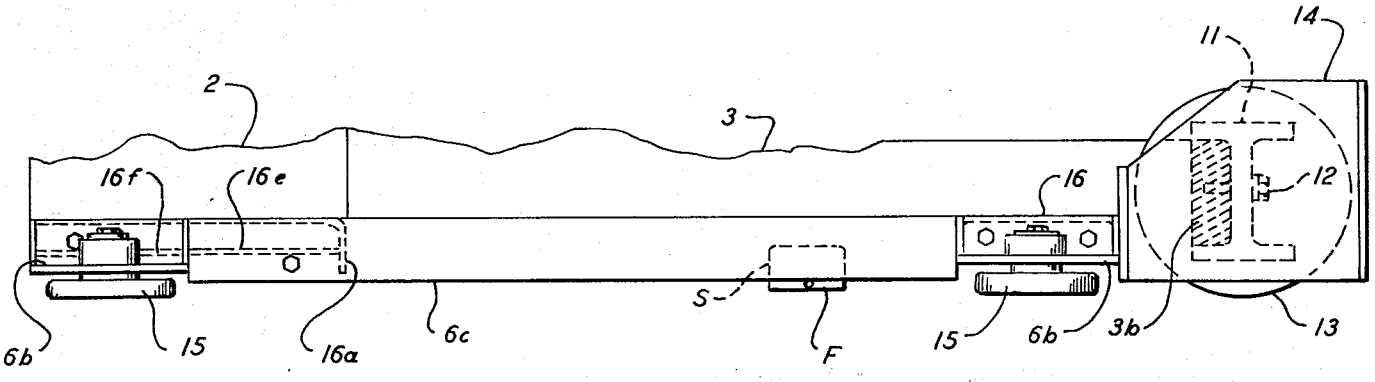

FIGS. 7*c* and 7*d* are plan and side elevation views illustrating a guide roller assembly and axle mounting arrangement which may be used on trucks constructed in accordance with the present invention.

FIG. 7*e* is a plan view illustrating an alternative spacer member which may be used.

Figure 1A:
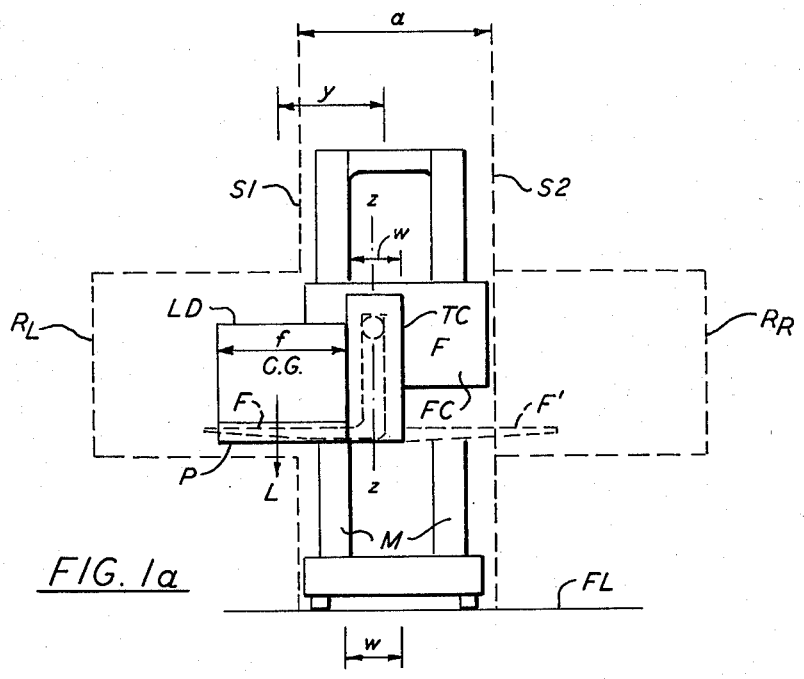

In the elevational diagram of FIG. 1*a* vertical dashed lines S1, S2 represent the sides of a warehouse aisle having a width of dimension *a* defined by the edges of storage racks which contain shelves on each side of the aisle, two such shelf spaces being represented in cross-section by the dashed line rectangles at $R_L$ and $R_R$. Certain portions of a truck which passes down the aisle to store and retrieve goods are shown, including a laterally-fixed carriage FC which may be raised and lowered to store or retrieve goods at or from shelves $R_L$, $R_R$ and similar shelves at higher and lower elevations. Carriage FC is supported on a truck mast formed by vertically extending members M, M along which carriage FC is raised and lowered by lift chains (not shown). A traverse carriage shown in generalized form as a rectangle at TC is mounted on fixed carriage FC for limited lateral shifting relative thereto. Traverse carriage TC pivotally supports a fork carriage (not shown) which carries a pair of load forks F which may be swung to point leftwardly, in the manner shown in FIG. 1*a*, wherein they are shown extending underneath a pallet P upon which a load LD is carried, or forks may extend forwardly, toward the viewer in FIG. 1*a*, or the forks may be swung to extend rightwardly, in the manner shown at F′ in FIG. 1*a*. It will be apparent that lateral shifting of carrige TC and forks F, and raising and lowering of carriage FC and TC and forks F, allows loads to be stored in and retrieved from shelf $R_L$ and shelves above and below shelf $R_L$, and that if forks F are pivoted 180° about axis *z*—*z*, that similar load storage and retrieval may be effected on the other side of the aisle. With the center-of-gravity C.G. of load LD substantially leftwardly from axis *z*—*z*, it will be apparent that a substantial counterclockwise lateral load moment is applied by forks F to carriage TC, and that similar moments are transmitted from carriage TC to carriage FC, and from carriage FC to the mast assembly, and thence from the base of the truck to the floor FL.

Figure 1B:
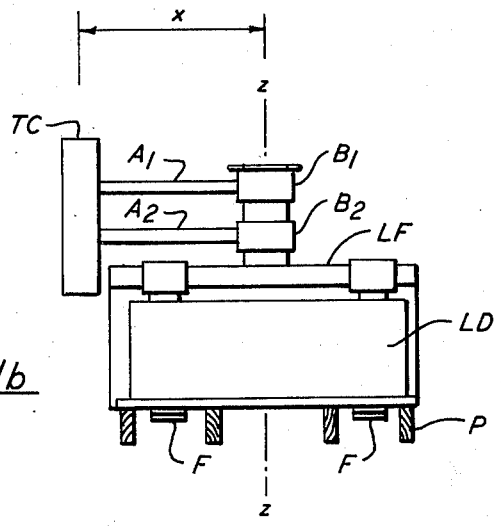

To conserve warehouse floor space, the aisle is desirably made as narrow as possible, so that the truck may pass down the aisle with very little clearance. To allow maximum lateral extension of forks F, so that a load may be deposited completely within a shelf space, fixed carriage FC must extend very nearly entirely across the aisle. In FIG. 1*a* load LD is shown having a lateral dimension *f* and traverse carriage TC as having a lateral dimension *w*. It will be seen that aisle width *a* must exceed the sum of dimensions *f* and *w*, with at least some clearance, to allow the load to be stored in and retrieved from the shelf space. It will also be seen that because the traverse carriage TC must be supported by the fixed carriage FC, the maximum allowable lateral travel of carriage TC tends to be decreased if traverse carriage width *w* is increased. Thus it is highly desirable that the lateral width *w* of the traverse carriage mechanism be kept as small as possible. With the C.G. of load LD located distance *y* from axis *z*—*z*, it will be apparent that forks F apply a counterclockwise lateral moment of magnitude L*y* to carriage TC. The lateral moment will tend to twist the traverse carriage structure itself, including the fork carriage, and similarly twist the structure which interconnects the fork carriage to the fixed carriage FC. If traverse carriage TC were coupled to fixed carriage FC by a rearwardly-extending shaft (not shown), it will be apparent that such a shaft would receive a torsional moment of magnitude L*y*. In FIG. 1*b* wherein portions of a typical prior art truck arrangement are shown diagrammatically in side elevation, a load fork carriage LF carrying forks F, F is pivotally mounted in bearings B1, B2 to allow 180° rotation of the forks about axis *z*—*z*, and a pair of arms A1, A2 support the bearings forward from the rear portion of traverse carriage TC. The arms A1, A2 may be stiffened by plates (not shown) which interconnect them, in a manner shown in U.S. Pat. No. 3,762,588, for example, so that they act as a unitary boom. Considering arms A1, A2 together as a unitary boom which transmits the lateral load moment rearwardly to laterally-shiftable structure TC carried on the truck mast, it will be seen that arms A1, A2 will tend to be twisted in opposite directions by a lateral load moment. Inasmuch as arms A1, A2 are vertically spaced quite close to each other, the boom will have a small torsional moment of inertia unless the arms have a large width, i.e. have large dimensions perpendicular to the plane of the drawing in FIG. 2. Also, bearings B1, B2 will tend to receive large unit stresses unless they have a substantial diameter. However, it will be seen that increasing the widths of the arms and the sizes of the bearings in order to reduce the stresses in those members undesirably tends to increase the lateral dimension of the structure interconnecting the fork carriage to the laterally-shiftable carriage, thereby limiting the length (dimension *f* in FIG. 1*a*) of the load which may be handled in an aisle of given width, and also limiting the allowable lateral travel of the fork carriage. Also, because fork carriage LF is supported solely at its upper edge, that carriage must be formed of heavy members to limit its deflection (when loaded) to an acceptable value.

Figure 1C:
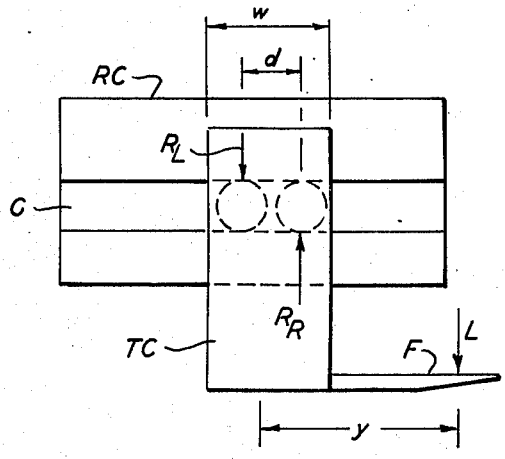
Figure 1D:
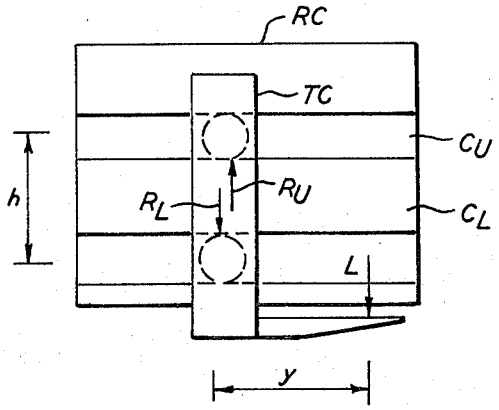

Some of the problems involved in providing a traverse carriage of narrow width and suitably supporting it from a rearward carriage if the traverse carriage is subject to large lateral moments may be better understood by consideration of FIGS. 1*c* and 1*d*. In FIG. 1*c*, a diagram representative of some prior trucks, a traverse carriage TC carrying forks F is assumed to have a pair of rollers journalled apart distance d on its rear side to ride in recess C of a rearward carriage RC to allow lateral movement of the traverse carriage. The moment L*y* caused by a load L will tend to rotate the traverse carriage clockwise, so that the leftward roller is urged against the upper edge of recess C and the rightside roller is urged against the lower edge of recess C. From elementary equations summing moments and vertical forces, one may readily deduce that the roller forces $R_L$ and $R_R$ are as follows.

$$R_L = \frac{Ly}{d} - \frac{L}{2}$$

$$R_R = \frac{Ly}{d} + \frac{L}{2}$$

The actual force on the rightside roller is in fact even greater, the two equations being simplified to neglect the weight of the traverse carriage itself. In FIG. 1*c* it is apparent that the traverse carriage width *w* must equal or slightly exceed twice the roller diameter. It is apparent that one could reduce dimension *w* by using roller of smaller diameter and reducing dimension *d*. However, as will be evident from the two equations, reduction of dimension *d* causes a rapid increase in the roller forces $R_L$ and $R_R$. Thus use of a wide spacing *d* undesirably widens the traverse carriage, requiring shorter loads or wider aisles, but conversely, the amount by which spacing *d* can be reduced is limited. Reducing spacing *d* beyond a certain point becomes self-defeating because it rapidly increases the roller forces, and increased roller forces require larger rollers and bearings, so that a point is soon reached where any further reduction in spacing *d* would not allow enough space to mount rollers and bearings of the sizes required to handle the roller forces. Various other approaches to the problem similarly offer no ready solution. One might initially assume that mounting one roller vertically above the other would allow significant reduction of carriage width *w*, which then would have to equal or exceed only one roller diameter, and that a wide vertical roller separation *h* could be substituted to reduce roller forces. Such a system is shown in the diagram of FIG. 1*d*. However, upon calculating the forces imposed upon the rollers in FIG. 1*d*, one finds that they become extremely large, making the arrangement of FIG. 1*d* completely impractical. The forces $R_U$ and $R_L$ on the upper and lower rollers in FIG. 1*d* depend upon how much "play" exists in the mechanism, which governs how much the traverse carriage TC and forks are allowed to tilt or rotate (angle $\alpha$) relative to the rearward carriage RC, expressions for the roller forces (with the traverse carriage weight being neglected) being as follows.

$$R_L = \frac{Ly}{h \tan \alpha} - \frac{L}{2}$$

-continued $$R_U = \frac{Ly}{h \tan \alpha} + \frac{L}{2}$$

It will be apparent from these equations that the roller forces approach infinite values unless the traverse carriage and forks are allowed to tilt through a completely unacceptable angle, even if vertical roller separation *h* is extremely large. Thus it should be apparent from FIGS. 1*c* and 1*d* that significantly reducing the width of a traverse carriage subject to large lateral load moments has presented a formidable problem. The problem, however, has been successfully solved by the present invention.

In accordance with one aspect of the invention, the traverse carriage is formed principally of a vertically-extending member (63 in FIGS. 4*a* and 4*b*) which has a modest lateral width, thereby allowing an amount of lateral carriage travel which is a larger percentage of the width of the rearward intermediate carriage on which the traverse carriage is supported. A pair of arms (87, 88 in FIG. 4*a*) on wider than the vertical member extend forwardly from the vertical member to rotatably support the fork carriage, but rather than supporting the fork carriage only at its top one of the arms extends below the bottom of the fork carriage. Such wide vertical spacing of the two arms, at a distance exceeding the height of the fork carriage, drastically decreases the forces applied to the arms and the bearings by a given laterally-acting load moment. In the specific device shown in FIG. 4*a*, lower stub shaft 94 is not vertically supported by lower arm 88, so that upper arm 87 receives the entire vertical load imposed on fork carriage 90. However, it is within the scope of the invention to instead support a part of the vertical load, or indeed all of the vertical load, by means of lower arm 88. In either case, of course, the relative sizes of the two arms would be varied in accordance with their loading.

One form of truck incorporating the present invention is generally shown in FIG. 7*a*. In FIG. 5 a complete carriage assembly is shown in side elevation in greater detail as including a laterally-fixed carriage 20 shown at the left side of FIG. 5, an intermediate carriage 45, and a traverse carriage 60 carrying a rotatable fork carriage 90 shown at the right side of FIG. 5. The laterally-fixed carriage 20 is raised and lowered up and down a mast 4 (FIG. 7*a*) in FIG. 5, being roller-guided by rollers 31–34 which act against the mast, and the raising and lowering of carriage 20 similarly raises and lowers carriages 45, 60 and 90. Intermediate carriage 45 is suspended on the front side (right side in FIG. 5) of fixed carriage 20 and capable of limited movement relative thereto in the lateral direction, i.e. normal to the plane of FIG. 5. Traverse carriage 60 is suspended from and movable laterally across the front face of intermediate carriage 45, and carries fork carriage 90, which is rotatable through 180° about a vertical axis. A clear understanding of the principles of the construction and operation of the assembly of FIG. 5 may be had by consideration of FIGS. 2*a*—2*c* which illustrate the fixed carriage 20 in detail, FIGS. 3*a*–3*c* which illustrate the intermediate carriage 45 in detail, and FIGS. 4*a* and 4*b* which illustrate the traverse carriage and fork carriage in detail.

Figure 2A:
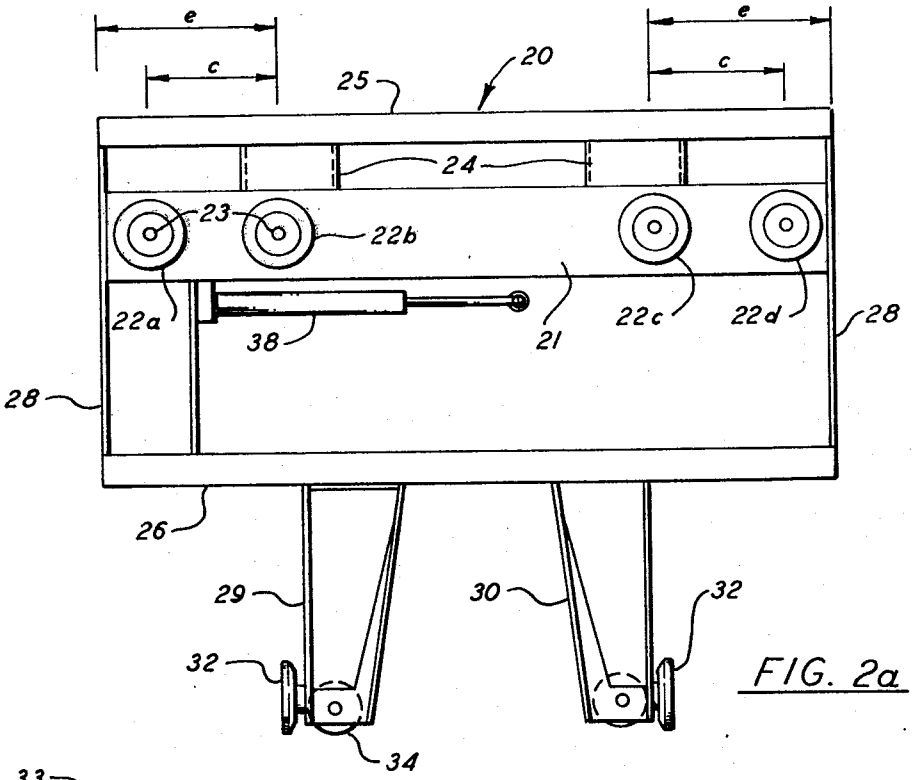
Figure 2B:
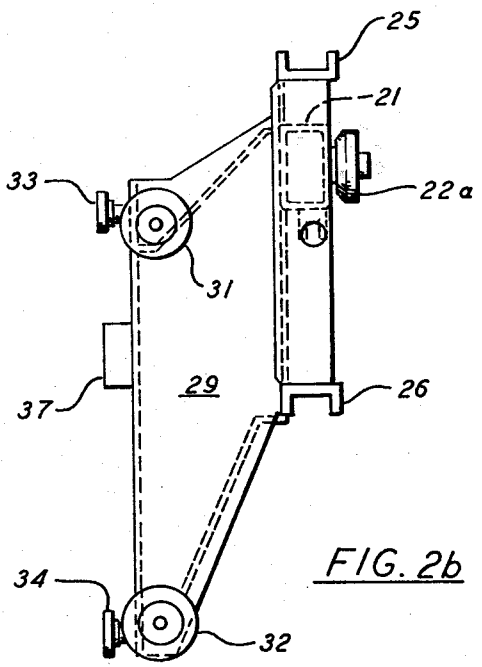
Figure 2C:
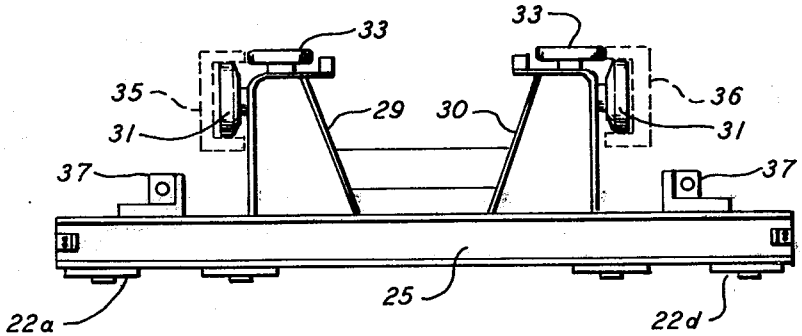

The vertically-elevatable laterally-fixed carriage 20 is shown in FIGS. 2*a*–2*c* as comprising a rectangular box-like frame having a horizontally-extending main member 21 shown in FIG. 2*b* as comprising a length of hollow rectangular tubing or box section. Four rollers 22*a*–22*d* are journalled on the front of member 21 on stub shafts 23, 23. A respective pair of the rollers is spaced adjacent each side of carriage 20, the rollers of each pair being spaced apart a distance indicated as dimension *c* in FIG. 2*a*. As will be seen below, rollers 22*a*–22*d* support the intermediate carriage 45 as it is shifted laterally relative to laterally-fixed carriage 20, and receive the full weight of the load, at least one roller of each pair being in engagement with the intermediate carriage at any lateral position of that carriage. A double-acting hydraulic cylinder 38 is fixedly mounted on the front side of main carriage 20, and upon assembly of the mechanism the ram of cylinder 38 engages a tab on the rear side of intermediate carriage 45, so that operation of cylinder 38 allows carriage 45 to be shifted laterally relative to carriage 20, over a total distance of approximately 9 inches in the specific embodiment being described. A pair of lengths 24, 24 of box section extending upwardly from main member 21 support an upwardly-facing channel 25 which extends across the top of carriage 20, and a similar but inverted channel 26 extends across the lower edge of carriage 20. Plate means 27 extending across the carriage between member 21 and channel 26, and end plates 28, 28, serve to rigidify the structure. A pair of main carriage roller ribs or brackets 29, 30 extend rearwardly from the rear face of carriage 20, each bracket carrying two longitudinally-acting rollers 31, 32 and two laterally-acting rollers 33, 34. The longitudinally-acting rollers 31, 32 each ride between a pair of flanges of a mast section, and the laterally-acting rollers 33, 34 each ride against the edge of a flange of mast section, as may be seen in FIG. 2*c* wherein two members of a mast section are shown in phantom as comprising vertically-extending channels 35 and 36. A pair of angle blocks 37, 37 on the rear of carriage 20 are provided for connection of lift chains (not shown) which raise and lower laterally-fixed carriage 20. To decrease the lateral bending moments applied to the mast sections, a chain arrangement of a type shown in U.s. Pat. No. 3,830,342 is preferred, although the present invention can, if desired, be used with other chain arrangements.

Figure 3A:
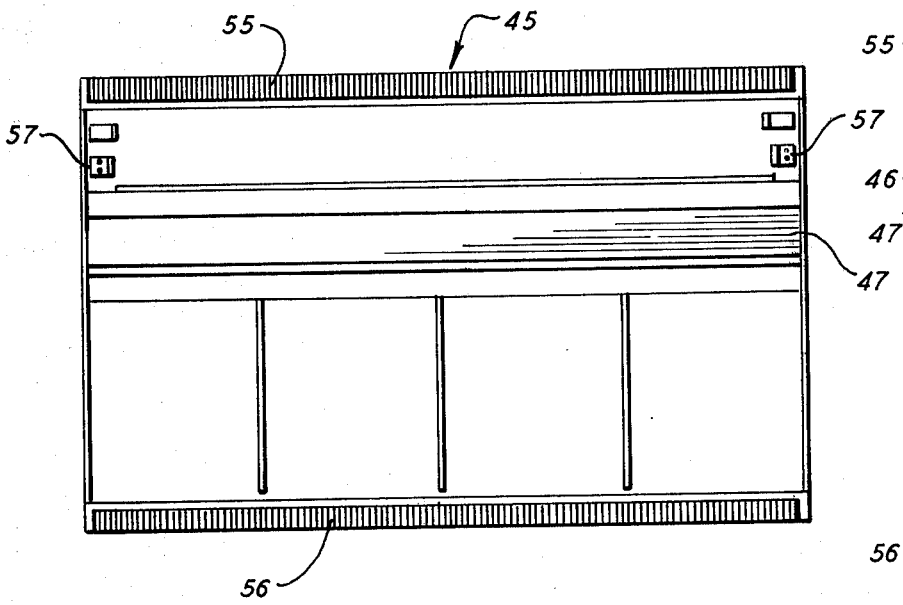
Figure 3B:
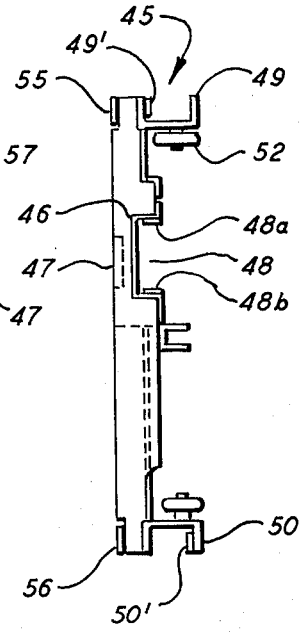
Figure 3C:
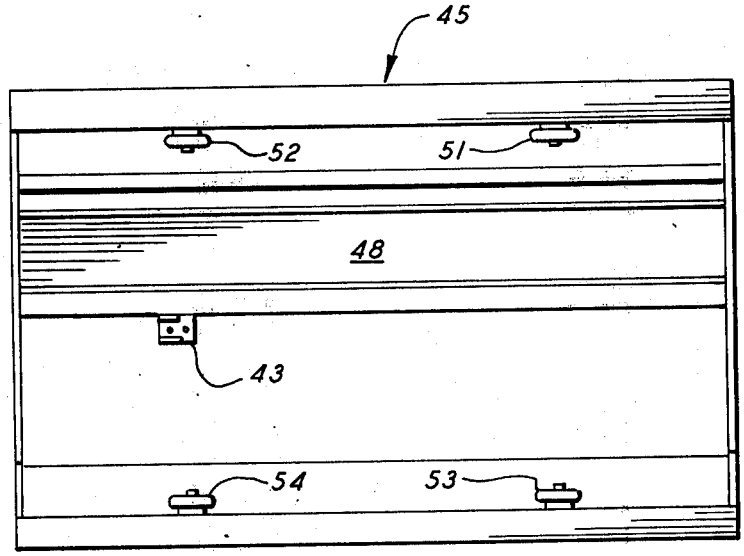

The laterally-shiftable intermediate carriage 45 is shown in FIGS. 3*a*–3*c* as generally comprising a rectangular reinforced weldment, the cross-section of which is best seen in FIG. 3*b*. Carriage 45, which is preferably about equal in width to the fixed carriage, includes a heavy laterally-extending member 46 having recesses 47 and 48 provided along its front and rear sides respectively. Upon assembly of the vehicle, as shown in FIG. 5, rollers 22*a*–22*d* (FIGS. 2*a*–2*c*) on the front of fixed carriage 20 ride in recess 48 on the rear side of intermediate carriage 45. Thus vertical forces caused by a load on the fork carriage are transmitted by intermediate carriage 45 to a pair of rollers, and any lateral moment imposed on the intermediate carriage is similarly transmitted to the pair of rollers, so that under various load conditions a given roller may ride against either the top or the bottom of recess 48. Hardened steel strips 48*a*, 48*b* are provided along the top and bottom of recess 48 to decrease wear. The distance between strips 48*a*, 48*b* exceeds the diameter of the rollers by only a small amount, of the order of 0.005 inch, so that the rollers may roll in recess 48 without binding, but so that no appreciable relative rotation occurs between carriages 20 and 45. With carriages 20 and 45 of equal width, and with rollers 22*b* and 22*c* each being mounted distance *e* from a respective end of carriage 20 as shown in FIG. 2*a*, it will be seen that intermediate carriage 45 may be lateral shifted from a centered position by an amount approaching distance *e* in either direction, until the axis of roller 22*b* or 22*c*, depending upon the direction of lateral shifting, is about to emerge from recess 48 of intermediate carriage 45. Even when carriage 45 has been shifted a distance approaching dimension *e*, lateral loads moments will be transmitted from carriage 45 to two widely-spaced rollers on the laterally-fixed carriage, and because the two rollers are widely spaced, minimum forces will be applied to the rollers for a given lateral load moment.

Channel member 49 extends across the top of carriage 45, and channel member 50 extends across the bottom. A pair of rollers 51, 52 journalled on stub shafts extending downwardly from channel 49 ride inside channel 25 (FIG. 2*b*) of the fixed carriage 20, and a pair of rollers 53, 54 journalled on stub shafts extending upwardly from channel member 50 ride inside channel 26 of the fixed carriage. The surfaces of the channels against which rollers 51–54 ride are machined flat. Thus rollers 51, 52 bearing against the forward flange of upper channel 25 of the laterally-fixed carriage, and roller 53, 54 bearing against the rear flange of lower channel 26 resist the longitudinal moment or couple which intermediate carriage 45 receives due to the longitudinal cantilevering of the load, with a pair of the rollers 22*a*–22*d* riding in recess 48 to receive the vertical load and any lateral moment or couple imposed on the intermediate carriage. As shown in FIG. 3*a*, the front side of carriage 45 carries gear rack 55 along its upper edge and gear rack 56 along its lower edge. Bracket 43 on the rear side of intermediate carriage 45 is engaged by double-acting hydraulic side-shift cylinder 38 (FIG. 2*a*), so that operation of cylinder 38 serves to laterally shift the intermediate carriage relative to the laterally-fixed carriage 20. A pair of angle 57, 57 tabs (FIGS. 3*a*) each carrying a polyurethane pad are mounted on the front of carriage 45 to serve as limit stops.

Traverse-carriage or load-handler 60 includes (FIGS. 4*a*–4*b*) a vertically extending length of box-section 63 having rearwardly-extending upper and lower arms 61, 62 welded thereto. The rear end of upper arm 61 carries rollers 64, 65, and the rear end of lower arm 62 carries rollers 66, 67. Upon assembly of the apparatus, as shown in FIG. 5, rollers 64, 65 ride inside channel 49 (FIG. 3*b*) pressing forwardly against a hardened steel insert strip 49′ carried inside the front flange of channel 49, and rollers 66, 67 ride inside channel 50 (FIG. 3*b*), pressing rearwardly against a hardened steel insert strip 50′ carried inside channel 50 on the rear flange thereof. Thus rollers 64–67 transmit the clockwise (in FIG. 4*a*) or longitudinal moment which is imposed on traverse carriage 60 by longitudinal cantilevering of the load rearwardly to intermediate carriage 45. The vertical force imposed by the load on traverse carriage 60 is transmitted from that carriage to intermediate carriage 45 by a single heavy roller 76, which rides in recess 47 (FIGS. 3*a*, 3*b*) across the front face of the intermediate carriage. Roller 76 is mounted rearwardly from box-section 63 by means of U-shaped bracket 77, the legs of which attach to member 63 and the rear section of which carries roller 76, journalled for rotation about a horizontal longitudinal axis. While the use of plural rollers in recess 47 transmits lateral moments rearwardly from intermediate carriage 45 to laterally-fixed carriage 20, it will be appreciated that the single roller 76 will not transmit lateral moments from traverse carriage 60 to intermediate carriage 45, and such lateral moments are instead transmitted from the traverse carriage to the intermediate carriage by means now to be described. A vertically-extending non-rotatable shaft 69 has a flanged upper end 69a (FIG. 4*b*) which is bolted to upper arm 61 by bolts 70, 70. Shaft 69 extends vertically through a hollow torque tube 71, being journalled in bearing 72 which is concentrically carried in gear or pinion 73, and journalled in a lower bearing 74 similarly carried in gear 75. The hubs of gears 73 and 75 are welded to the upper and lower ends of torque tube 71. Thus gears 73 and 75 and torque tube 71 are free to rotate relative to fixed shaft 69. Upon assembly of the truck upper gear 73 engages upper rack 55 (FIGS. 3*a*, 3*b*) extending across the upper front face of intermediate carriage 45, and lower gear 75 engages rack 56 extending across the lower front edge of carriage 45. In the specific device shown torque tube 71 is not journalled or supported by bracket 77, but it could be if so desired.

A hydraulic motor 80 mounted on box-section 63 drives sprocket 81 fixed to tube 71 via chain 82 and sprocket 83, with chain 82 passing through pairs of holes 84, 84 in the front and rear faces of box-section 64. Thus rotation of motor 80 in one direction or the other rotates tube 71 and gears 73, 75 act against racks 55, 56 to move traverse carriage 60 laterally in one direction or the other relative to intermediate carriage 45. Thus the torque tube 71, gears 73, 75 and racks 55, 56 act not only to transmit lateral load moments rearwardly from the traverse carriage, but also serve as the means for laterally translating the traverse carriage. Lateral movement of the traverse carriage is limited by stops 85 carried on bracket 77 which engage stops 57 (FIG. 3*a*) on the intermediate carriage. It is a feature of the invention that traverse carriage 60 has a minimum width (dimension *d* in FIG. 4*b*), which in turn minimizes the aisle width required for storage and retrieval of a given size load. Vertical member 63 may have a modest lateral width (which was approximately 8 inches in the embodiment being described), and no member which transmits forces rearwardly from member 63 to intermediate carriage 45 nor any member which receives forces from the fork carriage need have a lateral dimension exceeding that of member 63. Prior art traverse carriages tended to require substantially greater lateral space because lateral load moments had to be transmitted to laterally separated points on a rearward carriage to avoid the imposition of undesirable forces. In the invention, however, the forces caused by lateral load moments are coupled to points on the rearward (intermediate) carriage which have no lateral separation, i.e. upper gear 73 on the torque tube engages the upper rack 55 directly above where lower gear 75 engages lower rack 56.

Upper and lower arms 87, 88 extend forwardly from box-section 63 to support rotatable fork carriage 90, a stub shaft 91 journalled in the upper crossbar 92 of the fork carriage also being journalled in thrust bearing 93 carried on upper arm 87, and a stub shaft 94 fixed in the lower crossbar 95 being journalled in bearing 96 carried in lower arm 88, with bearings 93, 96 situated on a common axis *z—z* to allow rotation of the fork carriage about that axis. Thrust bearing 93 resists downward movement of shaft 91, while lower shaft 94 is arranged vertically slidable in lower bearing 96, and thus the entire vertical load imposed on fork carriage 90 is born by upper arm 87. It is not essential to practice of the invention that upper arm 87 extend forwardly from member 63 in a purely horizontal fashion. Also, if desired, a bracket (not shown) could extend between the outer end of arm 87 and the upper end of member 63 to resist a portion of the vetical load. Rotation of carriage 90 about axis *z—z* is effected by mutually-opposite movement of a pair of hydraulic cylinders 101, 102 mounted on member 63 and connected to upper shaft 91 by means of a length of chain 103 which engages sprocket 104 affixed to shaft 91.

Figure 4A:
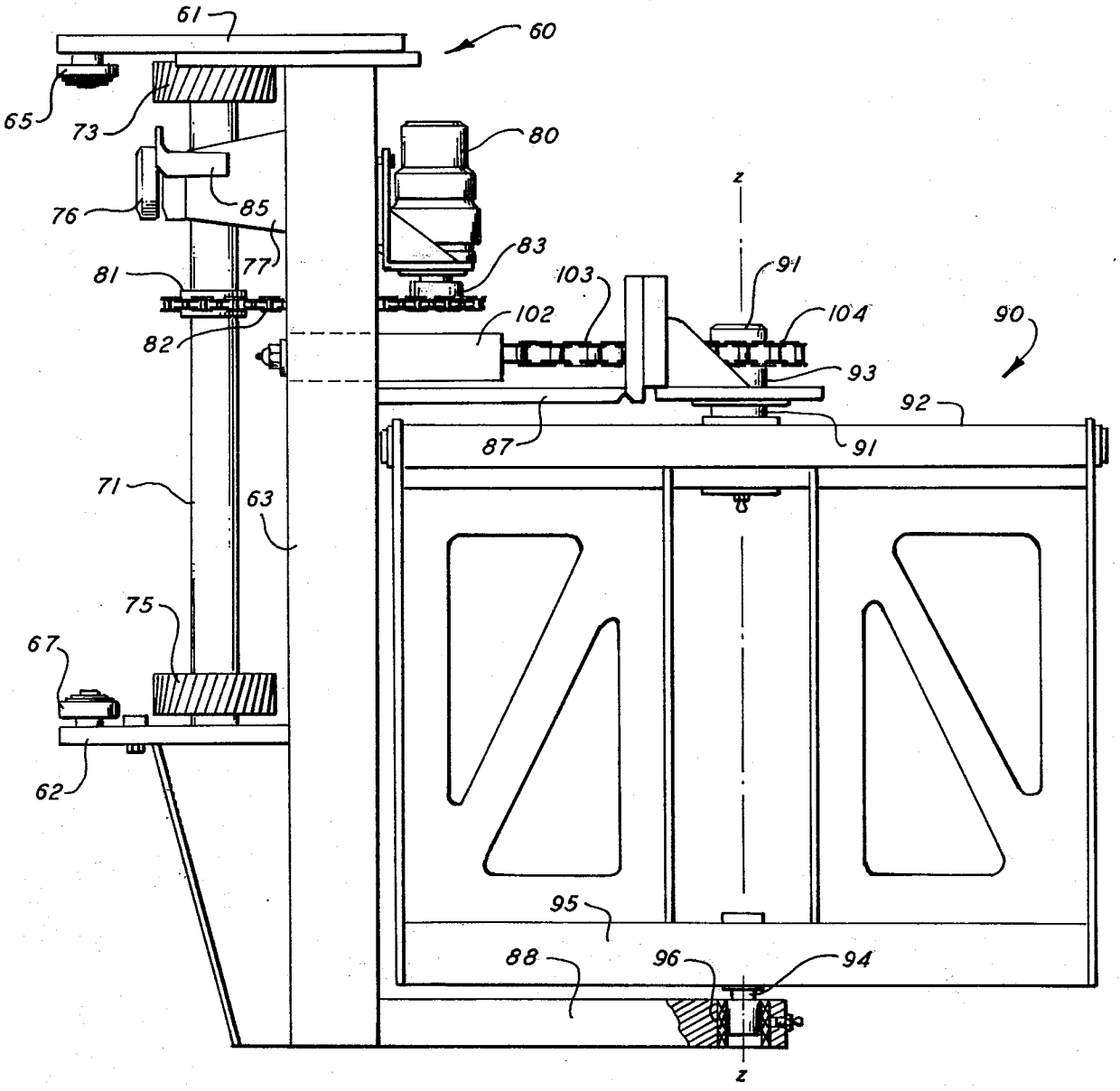
Figure 5:
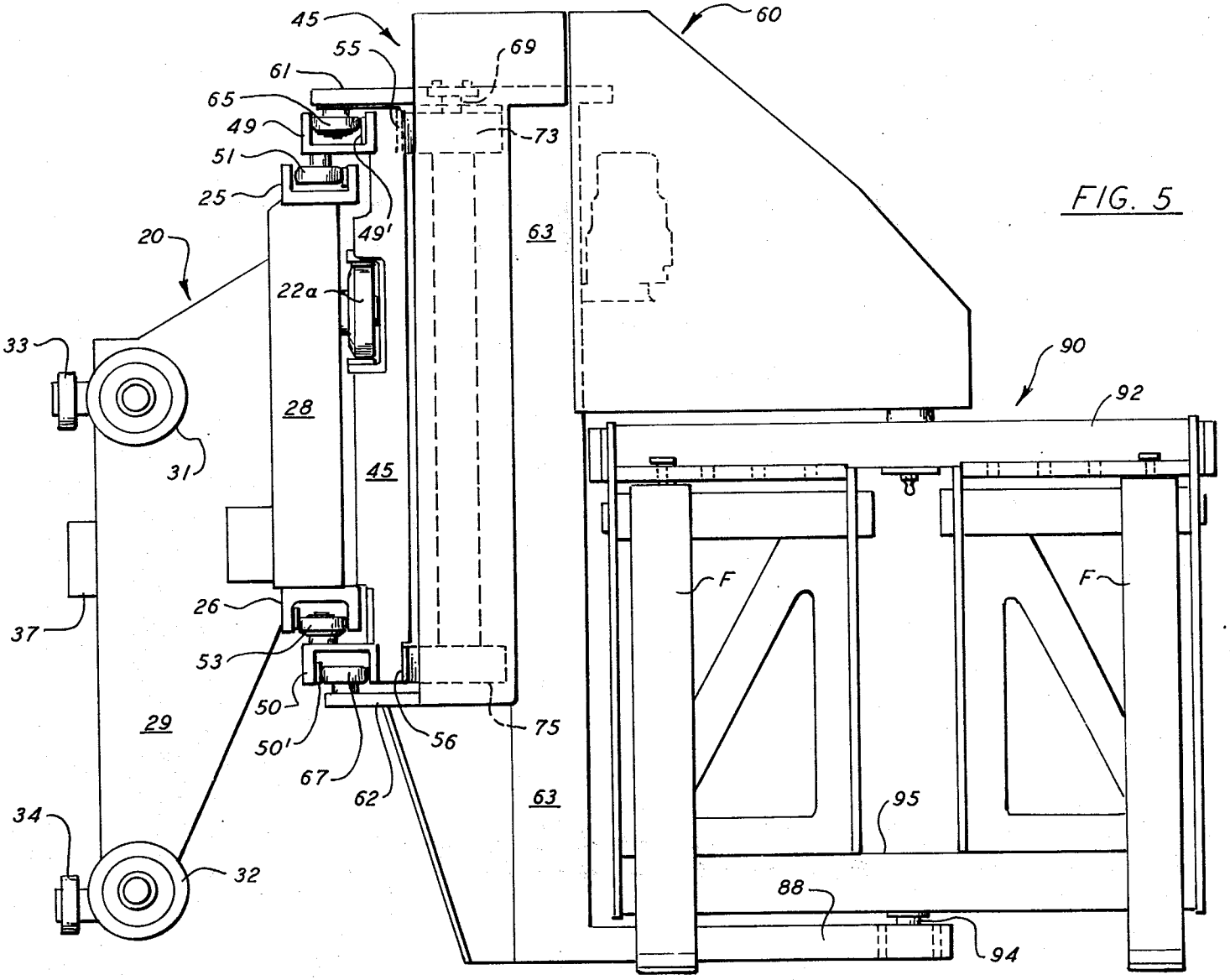
FIG. 5 is a side elevational view showing the fixed carriage portion, the intermediate carriage portion and the traverse carriage portion of the preferred embodiment assembled together.

Fork carriage 90, which is symmetrical about axis *z—z*, carries a pair of conventional L-shaped forks or tines in conventional manner, the forks not being shown in FIG. 4*a*, but one such fork being shown at F in FIG. 5. Each fork comprises a vertically-extending portion and a generally-horizontal portion extending therefrom. Each fork or tine is pivotally suspended from upper crossbar 92 of the fork carriage, and extends downwardly slightly below arm 88, so that the tips of the forks may engage the flow even though the bottom of lower arm 88 is several inches above the floor. The lower end of the vertical portion of each fork rests against lower crossbar 95, so that a load (not shown) carried in cantilever fashion on such forks will apply a moment and a downward force to fork carriage 90. The vertical force is transmitted to and resisted by deflection of upper arm 87, irrespective of the angular position of the fork carriage around axis *z—z*, while the load moment applied to the fork carriage acts laterally or longitudinally depending upon the angular orientation of the fork carriage about axis *z—z*.

If the load is centered on the forks and fork carriage 90 is rotated 90 degrees from the position shown in FIG. 4*a*, so that the forks extend forwardly, the C.G. (center of gravity) of the load will be situated forwardly from axis *z—z* but aligned longitudinally with axis *z—z* and vertical member 63, i.e. the load will be cantilevered longitudinally but will not be cantilevered laterally. The longitudinal moment will be resisted by tension in upper arm 87 and compression in lower arm 88, but no lateral load moment will tend to rotate the traverse carriage 60 about a horizontal longitudinal axis. At any other position of fork carriage about axis *z—z* a lateral load moment will occur, and if the forks extend 90° leftwardly or rightwardly from the forward direction, the load C.G. will be cantilevered laterally but aligned with axis *z—z*, i.e., not cantilevered longitudinally. The bending forces which a given lateral load moment applies to arms 87, 88 are inversely proportional to the vertical distance between arms 87 and 88, and hence the wide vertical separation of the two arms, with one above and one below the pivotable fork carriage, causes a given lateral load moment to apply minimum bending forces to arms 87, 88, greatly decreasing the weight required in such members for a given load capacity, and allowing arms of modest width to be used. The connection of arms 87, 88 to the vertical extremities of the fork carriage, near where the forks impose forces to the fork carriage, also serves to greatly reduce bending of the fork carriage itself, so that the fork carriage itself may be formed of lighter members for a given load capacity.

Figure 4B:
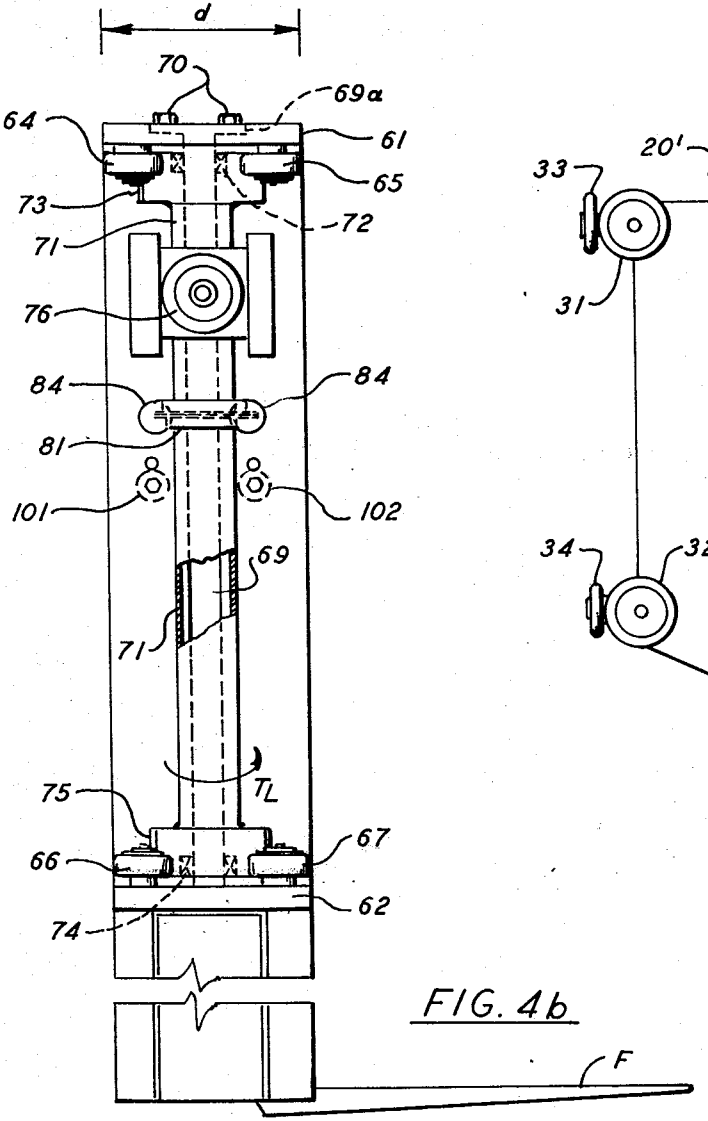

If, for example, fork carriage 90 is rotated 90° to extend the forks rightwardly, so that the load C.G. is positioned rightwardly from the traverse carriage in FIG. 4*b*, a clockwise moment will be applied by fork carriage 90 to vertical member 63 via arms 87 and 88. A lateral load moment tending to rotate traverse carriage 60 clockwise tends to move lower gear 75 leftwardly in FIG. 4*b*, so that the engagement of gear 75 with lower rack 56 on the intermediate carriage applies a torque to the lower end of torque tube 71, in the direction indicated by arrow $T_L$ in FIG. 4*b*, and simultaneously the engagement of upper gear 73 with upper rack 55 on the intermediate carriage causes gear 73 to apply an equal torque in the opposite direction to the upper end of torque tube 71. Thus the entire lateral load moment is resisted by torsional deflection or twisting of torque tube 71. Such a lateral load moment (i.e. with the load C.G. to the right of the traverse carriage when viewed in the forward direction) thus urges lower rack 56 rightwardly (in FIG. 3*a*) and upper rack leftwardly (in FIG. 3*a*) applying a CCW moment when viewed rearwardly as in FIG. 3*a*, or a CW moment when viewed forwardly, to the intermediate carriage. The torque tube is provided with sufficient torsional stiffness that a maximum lateral load moment causes insignificant relative rotation between gears 73 and 75, and hence insignificant tilting of the traverse carriage assembly. The non-rotatable shaft 69 and bearings 72, 74 serve as a means for rotatably journalling the torque tube 71 on the main vertical member 63 of the traverse carriage assembly 60. It is not necessary to the invention that torque be transmitted between gears 73–75 by means of a hollow tube, and a solid shaft could instead be suitably journalled to operate in similar fashion. Use of a hollow tube journalled from within is preferred, however, since it saves space and need not materially reduce the torsional stiffness of the torque absorbing member. Any laterally-acting rotational moment applied to the intermediate carriage, whether due to such cantilevering of the load laterally from the traverse carriage, or instead due to lateral displacement of the traverse carriage from the center of the intermediate carriage, is transmitted, of course, by intermediate carriage 45 to laterally-fixed carriage 20 by two rollers of the group 22*a*–22*d* (FIG. 2*a*) as previously described, and any laterally-acting rotational moment applied to laterally-fixed carriage 20 is, of course, furm ther transmitted to mast members 35, 36 (FIG. 2*c*) by rollers 33, 34 (FIGS. 2*b*, 2*c*) and resisted by deflection of the mast members.

The magnitude of the rightward and leftward forces which a given lateral load moment will apply to racks 55 and 56 varies inversely in accordance with the vertical distance between the two racks. The use of a long vertical torque tube 71, so that gears 73 and 75 may engage racks located at or near the vertical extremities of the intermediate carriage, thus causes a given lateral load moment to provide minimum possible forces between gears 73, 75 and racks 55, 56. Also, the use of a long torque tube causes a given lateral load moment to provide minimum torsional unit stress along the length of the tube, so that large lateral load moments may be transmitted from traverse carriage 60 to intermediate carriage 45, with a torque tube of modest diameter. Thirdly, and very importantly, the use of the vertically-extending torque tube allows minimum forces at racks 55–56 for a given lateral load moment without increasing the width of the traverse carriage.

It will be understood from the above that a first large vertical spacing between arms 87, 88 allows use of arms of less weight and of modest lateral width, and use of a fork carriage composed of lighter members, and that use of a second large vertical spacing between racks 55 and 56 minimizes the forces which result at the racks from a given lateral load moment. While the first and second vertical spacings are shown approximately equal in the specific embodiment described, it is in no way required that they be approximately equal. Also, while the vertical range of space between the racks 55, 56 is offset substantially upwardly from the vertical range of space between the arms 87, 88, such an arrangement is not a requirement of the invention, and was utilized in the specific embodiment merely so that the carriages 28 and 45 would not intrude down into space desired for the truck load wheels 13 when the fork carriage was lowered to its lowermost position, as will be apparent from FIG. 7*a*.

Figure 6:
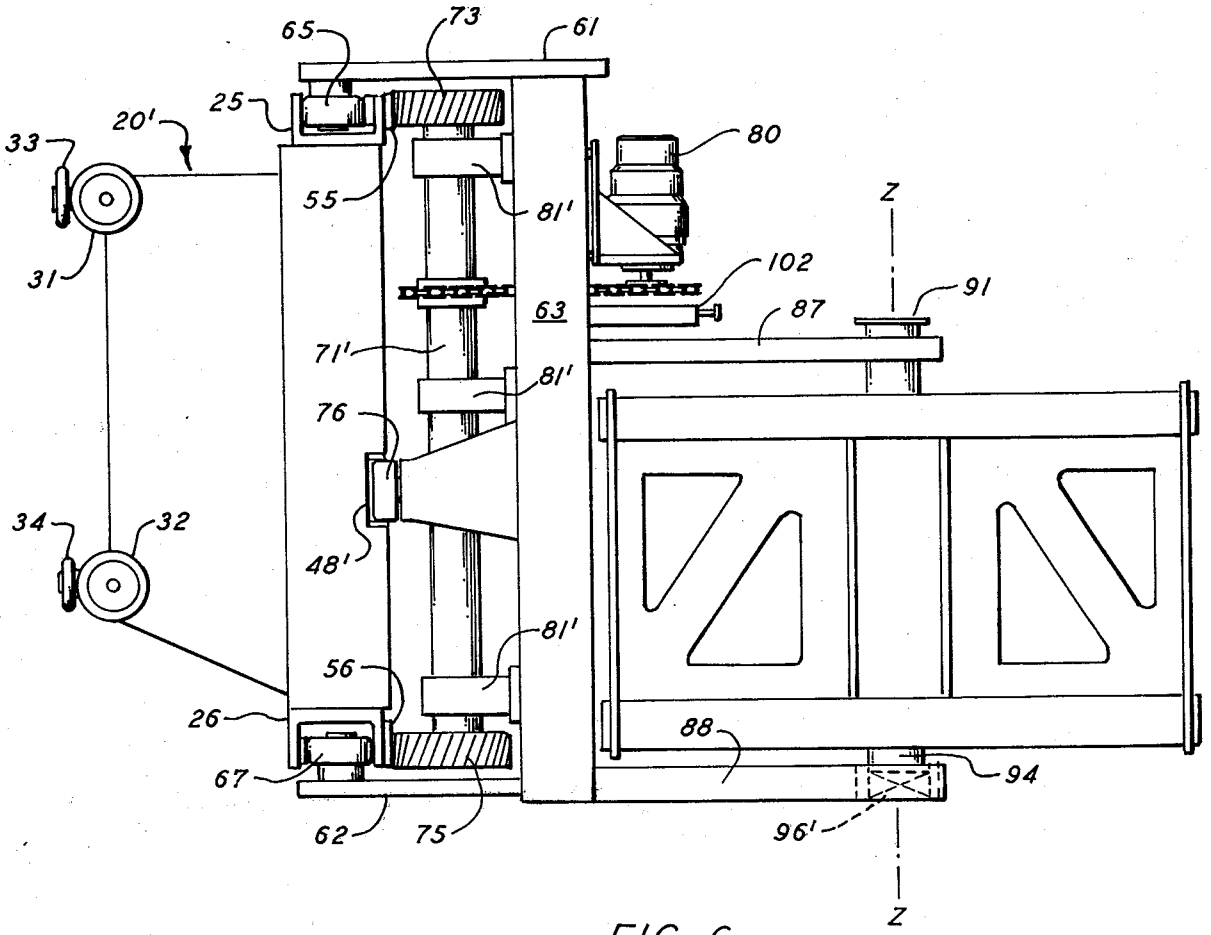
FIG. 6 is a side elevation view generally similar to FIG. 5 but illustrating a modified form of the invention.

FIG. 6 is a side elevational view similar to that of FIG. 5 illustrating one modified form of the invention wherein no intermediate carriage is utilized, and parts similar in principle to those of FIG. 5 are given the same reference numerals. In FIG. 6 the rollers 65, 67 on the arms 61, 62 extending rearwardly from vertical member 63 of the traverse carriage are situated in channels 25, 26 to transmit the longitudinal load moment from the traverse carriage to the elevatable and lowerable but laterally-fixed carriage 20′. The entire vertical force from the traverse carriage is applied to fixed carriage 20′ by means of roller 76 on the rear of the traverse carriage, which rides in channel 48′ provided across the front face of laterally-fixed carriage 20′. The lateral moment imposed on the traverse carriage by the load is transmitted by torque shaft 71′ and pinions 73, 75 to racks 55, 56 carried on the laterally-fixed carriage.

Several additional differences from the previously-described embodiment are shown in FIG. 6, although they could, if desired, be used in the device of FIGS. 2–5. Torque shaft 71′ is assumed to comprise a solid shaft rather than a hollow tube, and its ends and center are journalled in bearings carried in pedestals 81′ mounted on member 63. Upper stub shaft 91 of the fork carriage is vertically slidable on upper arm 87, while thrust bearing 96′ in lower arm 88 resists vertical movement of lower stub shaft 94, so that the vertical load on the fork carriage is transmitted to lower arm 88 instead of to upper arm 87. The torque tube extends vertically downwardly to approximately the lower extremity of vertical member 63, or to about the same level as lower arm 88.

FIG. 7*a* generally illustrates one form of truck which incorporates the previously-disclosed features of the invention. Trucks incorporating the invention are potentially useful in a variety of different warehouse applications, including warehouses having a number of different aisle widths and different storage rack heights. To provide maximum lateral stability, it is desirable that the truck-load supporting wheels be spaced laterally as far apart as possible, very near the racks on opposite sides of an aisle. With automatically-steered trucks it is also necessary that guide rollers and steering switches on opposite sides of the truck be spaced to engage floor-mounted guide rail tracks, or track portions of the racks. Because of the variety of different existing aisle widths, trucks of the prior art have incorporated heavy welded base frames of different widths.

This has not only tended to limit the use of a given truck to aisles of a given width, but has required the design and fabrication of many different sizes of base frames. To obviate such problems, trucks of the nature of FIG. 7*a* are preferably fabricated in the form of a few major assemblies of standard size. In FIG. 7*b* the major assemblies of the truck of FIG. 7*a* are shown separately from each other, including a power section 2, an intermediate frame section 3, an elevating section 4, and a load-handling section 5 which has already been described in detail. It will be apparent that power section 2 includes an operator's station with various controls, and a battery-compartment 2*a* (FIG. 7*a*), which in some applications of the invention could instead incorporate a gasoline or diesel engine, if desired. The intermediate frame section 3 includes a heavy welded base frame, of generally rectangular configuration, and one feature of the present invention is that frame section 3 may be fabricated in only one or a few different widths, and yet be readily used for trucks operable in aisles having a variety of different widths. The elevating section or mast assembly 4 is made in a few differing types, such as one-stage, two-stage and three-stage types, so that a mast assembly of any one of the types may be mounted on intermediate frame 3, depending upon the rack heights which the customer intends to use. In order that base frame 3 not be restricted to use with a single aisle width, the frame is constructed with a width consonant with the minimum aisle width for which it is to be employed. However, in order to provide maximum lateral stability, the main load-bearing wheels of the truck are not mounted directly on the heavy welded base frame, as has been usual in the prior art, but instead carried on the ends of a separately formed and removable axle member which preferably comprises a standard structural shape, such as an I-beam, and which is merely bolted to the front edge of the welded base frame. Inasmuch as the axle member comprises a standard structural shape, axle members having different lengths to provide maximum lateral stability in aisles of numerous different widths may be readily fabricated with no design engineering being required, and absolutely no modifications of the heavy welded base frame being required. Then further, because different aisle widths require different spacings of the guide rollers and steering switches if an automatic steering system is used, assemblies of a standard size carrying such guide rollers and switches may be attached to the sides of a truck using simple, easily-fabricated spacers which locate each guide roller a desired distance from the centerline of the truck. One guide roller assembly is shown at 6 in FIG. 7*b*. Thus a truck may be readily tailored for a given aisle width by the simple expedient of cutting one standard structural shape to a particular length, plus the fabrication of two pairs of simple spacer members to be described. As will be seen below, the spacer members, which need not be of great strength compared to base frame members, may be readily fabricated at little expense.

FIG. 7*c* and 7*d* show plan and side elevation views of the right side of the truck of FIG. 7*a*, and it will be understood that the left side is similar. The forward end of base frame 3 carries a heavy bar member 3*b* which extends across substantially the entire width of the base frame and which is provided with a cross-section (shown shaded in FIG. 7*d*) such that it fittedly nests between the flanges of a standard I-shape member 11, which is bolted to bar 3*b* by a plurality of bolts 12, 12. The load wheels 13 are mounted on opposite ends of member 11, preferably partially surrounded by wheel guards or bumpers 14. Member 11 is cut to a length dependent upon the width of the aisles in which the truck is intended to be used prior to the mounting of the load wheels and guards at its ends, and thus for different aisle widths, the load wheels and fenders will be spaced at different lateral distances from the longitudinal centerline of the truck. As shown in FIGS. 7*c* and 7*d*, each guide roller assembly may comprise a simple plate 6*a* carrying a pair of flat ledges 6*b*, 6*b* near its ends upon which guide rollers 15, 15 are rotatably journalled and positioned just above the floor level so that rollers 15 may engage a floor mounted track or rack edge. The portion of each guide roller assembly between the ledges is preferably stiffened by a cover plate 6*c*, providing a hollow housing in which a steering sensing switch S and wiring therefor may be protectedly mounted, with a switch operating finger or feeler F protruding laterally outwardly from the assembly to engage the track or rack edge.

The rear end of each guide roller assembly 6 is held at a fixed lateral position by means of a spacer member 16*a* which is shown as comprising a simple downwardly-facing channel-shaped member which extends between a rear portion of the truck and the rear end of a guide roller assembly. The channel of spacer member 16*a* is shown as including end plates 16*b* and 16*c* and stiffener plates 16*d*, 16*e* and 16*f*. In FIGS. 7*c* and 7*d* end plate 16*b* of rear spacer member 16*a* is shown bolted to the base frame of power section 2 and end plate 16*c* shown bolted to the rear end of plate 6*a* of guide roller assembly 6 by bolts 16*g*. The front end of assembly 6 is shown similarly attached to the base frame 3 by spacer member 16*h*, which is bolted to assembly 6 and frame 3 by bolts 16*i*. Spacer 16*h* is shown constructed identically to spacer 16*a* except made of lesser width. In the particular truck illustrated, rear spacer member 16*a* was given an increased width so that it would adequately support a battery during installation or removal of the same into or out of power compartment 2. A roller (not shown) may be provided on the upper face of spacer 16*a* to facilitate battery installation and removal. The length (dimension *s* in FIG. 7*c*) of each spacer member 16 for a given truck depends, like the length of I-shape 11, upon the aisle width intended for the truck. It will be apparent that provision of a pair of such spacer members with a given length and cutting of member 11 to a desired length are readily accomplished, and do not require any changes whatever in the heavy base frame 3 nor the base frame of power section 2. It will be apparent that since each guide roller assembly is made symmetrical in an endwise sense, a given assembly may be turned end for end and used on either side of the truck. Similarly, spacers 16*a* and 16*h* may be used on either side of the truck.

While axle member 11 is shown as comprising an I shape, it will be seen that its front flanges perform no function than to increase its bending strength, and thus it will be apparent that a rearwardly-facing channel shape of adequate strength could be substituted.

In FIG. 7*e* an alternative spacer member 16' is shown as comprising a pair of telescoping channel members 16*j*, 16*k* which may be fabricated with standard dimensions, adjusted to the length desired for a given truck, and then welded or bolted together at that relative position.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. A material-handling vehicle, comprising, in combination: a base frame; a mast assembly mounted on said base frame; a first carriage suspended from and guided for vertical movement by said mast assembly, said first carriage having four rollers journalled therein for rotation about horizontal longitudinally-extending axes and spaced in a row across the front side of said first carriage; an intermediate carriage mounted on said first carriage for lateral movement relative to said first carriage, said intermediate carriage including first and second channel recesses extending across the rear and front sides, respectively, of said intermediate carriage, and a pair of gear racks affixed to and extending across the front side of said intermediate carriage adjacent the upper and lower edges thereof, said four rollers being seated in said first recess on the rear side of said intermediate carriage; a traverse carriage mounted on said intermediate carriage for lateral movement relative to said intermediate carriage, said traverse carriage including a vertically-extending rigid member which extends to a level below the lower one of said gear racks, a further roller journalled on said vertically-extending rigid member for rotation about a longitudinal axis, said further roller being seated within said second recess on the front side of said intermediate carriage to transmit vertical force from said rigid member to said intermediate carriage; a pair of arms extending longitudinally forward in a fixed direction from said rigid member; a loadengaging carriage support between said arms for pivotal movement at least 90° in either direction from said fixed direction about a vertical axis adjacent the forward ends of said arms; a vertically-extending shaft means journalled on said rigid member; a pair of gears affixed to said shaft means, each of said gears engaging a respective one of said gear racks on said intermediate carriage, and first motive means mounted on said vertically-extending rigid member and connected to rotate said shaft means, thereby to move said traverse carriage laterally relative to said first carriage means, a first and a second of said four rollers on said first carriage are journalled on said first carriage adjacent the lateral edges thereof, respectively and the third and fourth rollers are spaced in between said first and second rollers, said third roller being closer to said first roller than to said fourth roller and said fourth roller being closer to said second roller than to said third roller, said shaft means comprises a hollow shaft carrying said gears, a fixed shaft extending through said hollow shaft and affixed to said rigid member, and bearing means for rotatably supporting said hollow shaft on said fixed shaft.

2. A vehicle according to claim 1 having second motive means comprising a hydraulic piston-cylinder assembly connected between said first carriage and said intermediate carriage.

3. A vehicle according to claim 1 wherein said shaft means is journalled on the rear side of said vertically-extending rigid member, and said first motive member, said shaft means carrying a sprocket, and chain means extending through said rigid member to connect said motor to said sprocket on said shaft means.

4. A vehicle according to claim 1 wherein one of said arms extends forwardly from said rigid member at a vertical level below the levels of each of said racks and gears.

5. A vehicle according to claim 1 having second motive means mounted on said vertically-extending rigid member and connected to pivot said load-engaging carriage, said second motive means comprising a pair of rams affixed to and extending forwardly from said rigid member above said pair of arms, said load-engaging carriage including a pivot shaft journalled in one of said arms, and chain-sprocket means connecting said rams to said pivot shaft.

* * * * *